United States Patent [19]

Babaskin et al.

[11] 4,133,680

[45] Jan. 9, 1979

[54] METHOD OF PRODUCING DOPANT MATERIAL FOR IRON OR NICKEL-BASE ALLOYS

[76] Inventors: Jury Z. Babaskin, ulitsa Zhelyabova, 10A, kv. 82; Viktor A. Efimov, ulitsa Vladimirskaya, 51/53, kv. 88; Leonid A. Sokirko, ulitsa Uritskogo, 102/7, kv. 53; Leonora A. Rostovskaya, ulitsa Dobrokhotova, 6, kv. 1A; Sergei Y. Shipitsyn, bulvar Lesi Ukrainki, 2, kv. 39; Georgy D. Semenyaka, ulitsa Semashko, 8, kv. 55/55; Georgy G. Lutsenko, ulitsa Borschagovskaya, 46/1, kv. 27, all of Kiev, U.S.S.R.

[21] Appl. No.: 854,018

[22] Filed: Nov. 22, 1977

Related U.S. Application Data

[63] Continuation of Ser. No. 690,777, May 27, 1976, abandoned, which is a continuation of Ser. No. 469,751, Sep. 14, 1974, abandoned.

[51] Int. Cl.$^2$ ..... C22C 38/22

[52] U.S. Cl. ..... 75/129; 75/123 R; 75/135; 75/170

[58] Field of Search ..... 75/129, 135, 123, 170

[56] References Cited

U.S. PATENT DOCUMENTS

| | | | |
|---|---|---|---|
| 3,028,234 | 4/1962 | Alexander | 75/134 R |
| 3,180,727 | 4/1965 | Alexander | 75/134 R |
| 3,749,569 | 7/1973 | Starr | 75/170 |
| 3,944,416 | 3/1976 | Walter | 75/170 |

*Primary Examiner*—P. D. Rosenberg
*Attorney, Agent, or Firm*—Haseltine, Lake & Waters

[57] ABSTRACT

A dopant material, comprising metallic elements constituting alloy base metals and endogeneous high-melting-point compounds selected from the group consisting of titanium, zirconium, tantalum, hafnium and thorium nitrides, carbides, carbonitrides, borides and oxides.

The dopant material for iron- or nickel-base alloys is produced by melting a dopant base metal, whereupon the elements required for the formation of the high-melting-point compounds selected from the group consisting of titanium, zirconium, tantalum, hafnium, thorium nitrides, carbides, carbonitrides, borides and oxides, are taken in a stoichiometric ratio and introduced into the melt. These elements are introduced into the melt at a temperature exceeding that required for the formation therein of such compounds. After that the melt with the elements introduced therein is cooled at a rate of $10^2$–$10^7$ degrees per second until high-melting-point endogeneous dispersed compounds are formed in the solidified base metal.

The present invention allows the production of the dopant materials which when used for modifying makes it possible to ensure an enhancement of a total range of properties, such as high-temperature strength, thermostability, crack resistance in casings and weldings, impact toughness, corrosion and erosion resistances in various aggressive media.

4 Claims, No Drawings

METHOD OF PRODUCING DOPANT MATERIAL FOR IRON OR NICKEL-BASE ALLOYS

This is a continuation of U.S. Ser. No. 690,777, filed May 27, 1976, now abandoned which in turn, is a continuation of U.S. Ser. No. 469,751, filed May 14, 1974, now abandoned.

The present invention relates to high-quality metallurgy of ferrous and non-ferrous alloys. More particularly, the invention is in the field of dopant materials for iron-or nickel-base alloys and methods of producing same.

The present invention may prove to be most advantageous in the production of iron- or nickel-base alloys featuring higher high-temperature strength along with high ductility and impact toughness, high-temperature resistance, corrosion, erosion and crack resistances.

Known at present are dopant materials for iron- or nickel-base alloys comprising, for example, in weight percent, chromium, 20–35; titanium, 5–10 and iron, the balance, or boron, 8–10; chromium, 11–14; silicon, 4.5–5.5; nickel, the balance. The above dopant materials are obtained by introducing the mentioned modifying agents into molten base metal.

The above-mentioned modifying agents can be introduced into the metal in a free state, though their introduction in the form of alloys in combination with other elements ensures stable assimilation of the modifying agent by the alloy. Thus, when introducing titanium into chromium-nickel steels, it is expedient that titanium be introduced as an alloy with iron, chromium and nickel.

A common disadvantage of the above elements as well as other modifying agents resides in that modification is accompanied by a liquational enrichment of grain interaxial sections and boundaries with the modifying agents being introduced by the formation of primary and secondary phases which are uncontrollable in size and distribution pattern and by interaction between the modifying agents and admixtures whose contents in the alloy are not constant.

Thus, when modifying an iron-base alloy with titanium, titanium nitrides are formed, coarsening arbitrarily with a temperature drop owing to adsorption growth and forming particles ranging in size from 10 to 20 mm and greater, whereas crystallization within interaxial sections is accompanied by the conglomeration of titanium nitrides. The modifying of a nickel-base alloy with boron is noted not only for structure refining but also for the formation of a boride phase along the grain boundaries.

The aforesaid phenomenon of the origination of the primary and secondary phases uncontrollable in size and distribution pattern and associated with the modifying agents being introduced restricts the possibility of improving alloy properties by such modifying agents insofar as it diminishes plastic characteristics and impact toughness of the alloys.

At the same time it is worth noting that the effect of modifying and improving such properties as ductility and impact toughness, high-temperature strength and thermal resistance, thermostability and crack resistance, corrosion and erosion resistances is not stable because the modifying agents interact with admixtures whose contents in the alloys are variable.

At present, high-temperature iron- and nickel-base alloys are the most widespread structural materials employed in various types of gas-turbine engines and power units, though the state of their properties does not meet modern technical standards.

Performance characteristics of machines and units can be substantially improved by enhancing such properties of the alloys as plasticity and impact toughness, high-temperature strength and thermal resistance, thermostability and crack resistance, corrosion and erosion resistances. The solution of the problem is complicated by the fact that no further improvement of the properties of these alloys by doping and microdoping can be achieved. To further complicate the matter, improvement of the chemical composition to provide high-temperature strength characteristics, it adversely affects mechanical and technological properties. The known alloys featuring highest high-temperature strength are already characterized by a critical relation between their thermal resistance, mechanical and technological characteristics.

Accordingly, studies on improving properties of alloys are aimed at providing a more advanced technique for the production of such alloys and workpieces made therefrom. For instance, a deeper vacuuming of alloys is resorted to or workpieces are produced from single crystals.

Known at present are attempts at modifying alloys with briquettes obtainable by powder metallurgy techniques and representing a compacted mixture of pulverized metals and particles of synthetic high-melting-point compounds.

The above synthetic high-melting-point particles are produced by mechanical grinding and thus have an irregular acute-angled shape like crystal splinters. This adversely affects their properties, resulting in a reduction in high-temperature strength and in mechanical, heat-resisting and fatigue characteristics in an alloy modified with such briquettes.

Moreover, it is to be noted that the known methods of producing the above briquettes is inefficient and does not ensure dispersed, uniformly distributed particles of high melting point compounds in a briquette base. This is attributable to the fact that pressing a mixture of metallic powders and high melting point compounds leads to the formation of particle conglomerates which coalesce on being introduced into an alloy. At the same time, the modifying of alloys is accompanied by a developing process of particle coarsening due to coagulation. The latter is caused by a low inherent wettability of the high melting point particles. In this case the wettability diminishes further because of an oxide film formed on the particles of the synthetic high melting point compounds.

Therefore, the modifying of alloys with such briquettes is usually accompanied by a reduction in the plastic properties and the impact toughness.

It is an object of the present invention to overcome the above disadvantages.

Still another object of the invention is the provision of a dopant material for iron- or nickel-base alloys which would ensure simultaneous enhancement of plasticity, impact toughness, high-temperature strength and thermostability, heat resistance, corrosion, crack and erosion resistance of the alloys.

Yet another object of the present invention is to provide a method which would enables the production of dopant materials which ensure simultaneous enhancement of plasticity, impact toughness, high-temperature strength, thermostability and heat resistance as well as crack, corrosion and erosion resistance of the iron- or nickel-base alloys.

The objects are achieved by providing a dopant material for iron- or nickel-base alloys comprising a metal element, an alloy base and modifying agents which, according to the present invention, contain dispersed high-melting-point titanium, zirconium, tantalum, hafnium or thorium nitrides, carbides, carbonitrides, borides and oxides amounting to 3–25 volume percent, taken separately or in combination as the modifying agents.

Modifying the alloys with the proposed dopant material results in improving the entire range of their properties, such as high-temperature strength, thermostability, crack resistance in castings and weldings, impact toughness and corrosion and erosion resistance in various aggressive media. A higher state of properties of the iron- or nickel-base alloys provides for a more than 100% increase in service life of aircraft, naval and other engines and thermal plants.

It is expedient that the elements forming the nitrides, carbides, carbonitrides, borides and oxides be taken in a stoichiometric ratio.

The use of dopant materials, comprising, according to the invention, the elements forming high-melting-point compounds taken in a stoichiometric ratio made it possible to efficiently enhance the alloy characteristics.

Moreover, it is sound practice that the above compounds be composed of particles not more than 5$\mu$ in size.

The presence in the proposed dopant material of the high-melting-point particles not more than 5$\mu$ in size is a prerequisite of efficient modifying, insofar as larger particles adversely affect plastic properties and impact toughness of the alloys.

Another embodiment of the present invention consists in additionally introducing manganese, silicon and molybdenum into the dopant material in amounts not in excess of 50 weight percent.

Owing to the presence of the above elements in the dopant material, the dopant base metal has imparted thereto a certain degree of embrittlement along with a reduction in the dopant material melting point which improves the introduction of it into the alloy.

Another embodiment of the present invention consists in additionally introducing rare-earth metals amounting to not more than 10 weight percent into the dopant material.

The use of the dopant material comprising the rate-earth metals results in obtaining high melting point compounds composed of particles not more than 5$\mu$ in size.

In addition, it is expedient that the dopant material contain chromium not in excess of 50 weight percent.

The presence of chromium in the dopant material makes it possible to enhance wettability of the particles of high melting point nitrides and carbonitrides and to diminish the rate of their coagulation in liquid metal.

The herein-proposed dopant material for iron- or nickel-base alloys can be produced by melting the dopant base metal and introducing the modifying agents into the melt, with the elements required for the formation of the high melting point compounds which are, according to the invention, selected from the group consisting of titanium, zirconium, tantalum, hafniun and thorium nitrides, carbides, carbonitrides, borides and oxides which are introduced in a stoichiometric ratio into the above melt which has a temperature exceeding that at which the aforesaid high melting point compounds form in the melt, the latter being cooled after that at a rate of $10^2$–$10^7$ degrees per second until the high melting point endogeneous dispersed compounds are formed in the solidified base metal.

According to the present invention, it is expedient that manganese, silicon and molybdenum amounting to not more than 50 weight percent be introduced additionally into the molten base metal.

Moreover, another embodiment of the present invention resides in introducing additionally rare-earth metals in amounts not exceeding 10 weight percent into the molten base metal.

It is also advisable that chromium amounting to not more than 50 weight percent be introduced additionally into the melt.

The proposed method permits the production of the dopant materials of the above-mentioned composition ensuring at the same time the formation of the mentioned high melting point modifying compounds in the form of dispersed isolated particles not more than 5$\mu$ in size.

Other objects and advantages of the present invention will become more apparent by reference to the following detailed description.

The dopant material for iron- or nickel-base alloys according to this invention comprises an alloy base metal element, for example, iron or nickel, and particles not more than 5$\mu$ in size of the modifying high melting point compounds which are titanium, zirconium, tantalum, hafnium, thorium nitrides, carbides, carbonitrides, borides and oxides. The invention envisages the possibility of using a dopant material comprising either one of the above-mentioned compounds or a combination of several high melting point compounds amounting to 3–25 volume percent.

It has been established that a prerequisite stipulating efficient modifying with the dopant materials comprising the aforesaid high melting point compounds is their resistance to the solution and coagulation in a liquid and solid alloy, crystallographic affinity to the alloy base metal and to the primary and secondary segregation phases.

Generally titanium, zirconium, tantalum, hafnium and thorium form most stable thermodynamically high melting point compounds of different classes, with the compound stability increasing in the following order: carbides, carbonitrides, nitrides, borides, oxides, the wettability determining their liability to coagulation in a liquid alloy diminishing in the same order. Therefore, the efficiency of modifying with the dopant materials comprising the high melting point compounds of the above elements, taken either separately or in combination, depends upon the chemical composition of the alloy and the time-temperature conditions under which it is produced.

The inherent wettability of the above compounds being insufficient, it is increased in the dopant material to a requisite level by producing endogeneous, that is, originated directly within the cast base metal, high melting point compounds possessing a higher wettability resulting from a transition layer formed when the above compounds come in contact with the solidifying base metal. In such case, the level of the acquired wettability diminishes with an increase in compound stability.

Moreover, the rate of coagulation of the high melting point compounds being introduced during modifying depends also upon the uniformity of their distribution in the dopant material. A minimum rate takes place with isolated dispersed distribution of the particles of the high melting point compounds, that is, with the above particles being separated with the dopant base metal. An upper limit determining the contants of the high melting point compounds in the dopant material depends upon the above condition.

According to the present invention, there is introduced into the dopant material the elements forming high-melting point titanium, zirconium, tantalum, hafnium and thorium nitrides, carbides, carbonitrides, borides and oxides in a stoichiometric or a ratio close to it. In case the contents of the above elements exceeds substantially a stoichiometric ratio, it may cause microalloying of grain boundaries and the formation of the primary and secondary phases uncontrollable in size and distribution patterns resulting in turn in a reduction in the properties of the modified alloy.

The presence in the dopant material of the high melting point particles of not more than $5\mu$ in size is a prerequisite for efficient modifying, since larger particles adversely affect the plastic characteristics and impact toughness of alloys.

Introducing into the dopant base metal a pair or a combination of pairs of thermodynamically active elements selected from the group consisting of titanium, zirconium, tantalum, hafnium and thorium in combination with nitrogen, carbon, boron and oxygen in a stoichiometric weight percentage which is needed to form 3–25 volume percent of nitrides, carbides, carbonitrides, borides and oxides, is sufficient for the formation of the particles of the above high melting point compounds of arbitrary size and distribution in the base metal. A prerequisite for producing dispersed particles of the high melting point compounds isolated from one another by the base metal is a time limitation of the temperature conditions under which they form to fractions of a second to inhibit the processes of crystal growth of the particles of the high melting point compounds and of their coagulation. The above processes were found not to reach a critical state when a pair or a combination of pairs of the aforesaid elements is introduced into the molten dopant base metal whose temperature exceeds that of formation of the above compounds and when the homogeneous molten dopant material is cooled down at a rate of $10^2$–$10^7$ degrees per second. In this case in order to produce the dispersed isolated particles of the high melting point compounds not more than $5\mu$ in size, the rate of cooling of the dopant material should be increased from $10^2$ to $10^7$ degrees per second, their volume contents increasing from 2 to 25 percent.

In another embodiment of the invention there is introduced into the molten base metal of the dopant material, apart from the aforesaid elements, manganese, silicon and molybdenum in amounts not exceeding 50 weight percent. These are needed to reduce the melting point and that of formation of intermetallic phases embrittling the base metal, thus enhancing the technological characteristics of the dopant material.

It has been found that the rare-earth metals should be introduced into the molten base metal of the dopant material in amounts not exceeding 10 weight percent as a means of inducing a higher rate of cooling and restricting; the crystal growth of the particles of the high melting point compounds, and thus contributing to a reduction in their size.

According to the present invention, the dopant material may contain chromium. The introduction of not more than 50 weight percent of chromium into the molten base metal is dictated by a need for a higher solubility of nitrogen which facilitates its introduction into the melt in required amounts.

The upper limit of chromium content restricts the region within which the base metal retains the crystallographic parameters required for the formation of the high melting point compounds of the transition layer needed for enhancing their wettability and decreasing their rate of coagulation in molten metal.

Modifying with the proposed dopant material ensures a substantial reduction in size of primary crystallites, interaxial distances, disorientation angles of polygonization grains, a higher dispersion and more uniform distribution of primary and secondary segregation phases. This results in a 2 to 5-fold increase in the total range of alloy properties, such as, high-temperature strength and thermostability, heat and crack resistance in casting and welding, plastic properties, impact toughness and corrosion and erosion resistance in various aggressive media. An increase in the state of properties of the iron- and nickel-base alloys provides for more than a 100% increase in service life of aircraft, naval and other engines and thermal plants.

Other advantages of the present invention will be more apparent by reference to the following illustrative examples of the embodiments of the dopant material of this invention.

EXAMPLE 1

Upon introducing chromium, 20 weight percent, manganese, 10 weight percent, silicon, 10 weight percent and a metal selected from the group consisting of rare-earth metals, 1 weight percent, into molten iron, the melt is heated to a temperature of 1800° C.

Next 0.14 weight percent of carbon, 1.2 weight percent of titanium, 1.21 weight percent of zirconium and 0.27 weight percent of nitrogen are introduced into the melt in a stoichiometric ratio required for the formation of 0.98 volume percent of titanium nitride 1.00 volume percent of titanium carbide, 1.07 volume percent of zirconium nitride and 0.29 volume percent of zirconium carbide.

The molten iron together with the elements introduced therein is held at a temperature of 1800° C. for 2 minutes and then cooled at a rate of $10^2$ degrees per second until 3.34 volume percent of high melting point zirconium and titanium nitrides, and zirconium and titanium carbides are formed in a solidified base metal (iron) of the dopant material.

The resultant dopant material is introduced into chromium-nickel steel in amounts of 100 kg per ton of metal at a temperature of 1650° C. In 3 minutes the metal is poured into moulds at a temperature of 1580° C.

Characteristics of nonmodified and modified steel are given in the following Table which shows that modification resulted in a substantial enhancement of the plastic properties, impact toughness and stress-rupture strength wherein:

$\sigma_b$ tensile strength;
$\delta$ elongation;
$\psi$ reduction of area;
$\alpha_k$ impact toughness;

Table 1

| Steel kind | Mechanical properties $\sigma_s$ kgm/mm$^2$ | $\delta$ % | $\psi$ % | $a_k$ kgm/cm$^2$ | $\tau$ hr | Stress-rupture strength Testing conditions |
|---|---|---|---|---|---|---|
| Non-modified | 56 | 15 | 28 | 5.0 | 50 | $\sigma$ = 16 kg/mm$^2$ T = 700° C |
| Modified | 65 | 39 | 46.0 | 8.0 | 88 | " |

EXAMPLE 2

35 weight percent of chromium, 10 weight percent of silicon, 5 weight percent of a metal selected from the group consisting of rare-earth metals are introduced into molten iron whereupon its temperature is increased to 2200° C.

Next 1.48 weight percent of carbon, 7.2 weight percent of titanium, 7.8 weight percent of zirconium and 1.0 weight percent of nitrogen are introduced into said melt in a stoichiometric ratio required for the formation of 3.50 volume percent of titanium nitride, 8.55 volume percent of titanium carbide, 4.16 volume percent of zirconium nitride and 4.76 volume percent of zirconium carbide.

Upon being held for 2 min at a temperature of 2200° C., the iron melt together with the above elements introduced therein is cooled at a rate of $10^7$ degrees per second until 20.97 volume percent of dispersed high melting point zirconium and titanium nitrides and titanium and zirconium carbides are formed in the solidified iron.

The dopant material thus obtained is introduced into chromium-nickel steel in amounts of 25 kg per each ton of metal at a temperature of 1620° C. In 3 minutes the metal is poured at a temperature of 1580° C.

Characteristics of nonmodified and modified steel are given in Table 2 which shows that modifying ensures a substantial enhancement of the stress-rupture strength without impairing the plastic properties and impact toughness of the metal.

Table 2

| Steel kind | Mechanical properties kg/mm$^2$ $\sigma_s$ | % $\delta$ | % $\psi$ | kgm/cm$^2$ $a_k$ | hr $\tau$ | Stress-rupture strength Testing conditions |
|---|---|---|---|---|---|---|
| Nonmodified | 55 | 14.5 | 26.5 | 5.5 | 57 | $\sigma$ = 16 kg/mm$^2$ T = 700° C |
| Modified | 60 | 17.0 | 27.0 | 7.0 | 250 | " |

EXAMPLE 3

15 weight percent of chromium, 30 weight percent of molybdenum are introduced into molten nickel and whereupon its temperature is increased to 1800° C.

Following that 0.15 weight percent of carbon, 0.19 weight percent of nitrogen, 0.20 weight percent of boron, 1.18 weight percent of titanium, 1.74 weight percent of zirconium are introduced into the above melt in a stoichiometric ratio required for the formation of 0.77 volume percent of titanium nitride, 0.84 volume percent of titanium carbide, 0.95 volume percent of titanium boride, 1.02 volume percent of zirconium nitride, 0.85 volume percent of zirconium carbide, 0.62 volume percent of zirconium boride.

Molten nickel with the above elements introduced therein is held at a temperature of 1800° C. for 2 minutes, whereupon it is cooled at a rate of $10^2$ degrees per second until 5.05 volume percent of dispersed high melting point titanium and zirconium nitrides, titanium and zirconium carbides and titanium and zirconium borides are formed in the solidified nickel which is the dopant base.

The dopant material thus obtained is introduced into a nickel-base alloy in amounts of 120 kg per ton of metal at a temperature of 1650° C. In 3 minutes the alloy is poured at a temperature of 1570° C.

Characteristics of the nonmodified and modified alloy are given in Table 3 which shows that modification ensures a substantial enhancement of the plastic properties, impact toughness and stress-rupture strength wherein:

$\delta_s$ is the yield point.

Table 3

| Kind of alloy | Mechanical properties $\sigma_s$ kg/mm$^2$ | $\sigma_s$ kg/mm$^2$ | $\delta$ % | $\psi$ % | $a_k$ kg/cm$^2$ | $\tau$ hr | Stress-rupture strength Testing conditions |
|---|---|---|---|---|---|---|---|
| Nonmodified | 42 | 60 | 12 | 16 | 7.5 | 100 | $\sigma$ = 40 kg/mm$^2$ T = 700° C |
| Modified | 47 | 68 | 17.5 | 37 | 15 | 600 | " |

EXAMPLE 4

3.5 weight percent of chromium are introduced into molten nickel, whereupon its temperature is increased to 2200° C. Then a metal selected from the group consisting of rare-earth metals is introduced into the melt in an amount of 7 weight percent.

Following that 0.75 weight percent of carbon, 0.80 weight percent of nitrogen, 1.1 weight percent of boron, 5.36 weight percent of titanium and 8.99 weight percent of zirconium are introduced into the above melt in a stoichiometric ratio to form 3.43 volume percent of titanium nitrides, 3.96 volume percent of titanium carbides, 3.99 volume percent of titanium borides, 4.08 volume percent of zirconium nitrides, 4.25 volume percent of zirconium carbides and 4.66 volume percent of zirconium borides.

Molten nickel with the aforesaid elements introduced therein is held at a temperature of 2200° C. for 2 minutes after which it is cooled at a rate of $10^7$ degrees per second until 24.37 volume percent of dispersed high melting point titanium and zirconium nitrides, titanium and zirconium carbides and titanium and zirconium borides are formed.

The dopant material thus obtained is introduced into a nickel-base alloy in amounts of 30 kg per each ton of metal at a temperature of 1650° C. In 3 minutes the metal is poured at a temperature of 1580° C.

Characteristics of the nonmodified and modified alloy are tabulated in Table 4 which shows that modification results in a substantial enhancement of impact toughness and stress-rupture strength without impairing the plastic properties of the alloy.

Table 4

| | Mechanical properties | | | | | Stress-rupture strength |
|---|---|---|---|---|---|---|
| Kind of alloy | $\sigma_s$ kg/mm$^2$ | $\delta$ % | $\psi$ % | $\alpha_k$ kgm/cm$^2$ | $\tau$ hr | Testing conditions |
| Nonmodified | 92.4 | 6 | 10.1 | 2.9 | 131 | $\sigma$ = 35 kg/mm$^2$ T = 850° C |
| Modified | 99.4 | 8.6 | 12 | 8.2 | 431 | " |

EXAMPLE 5

25 weight percent of chromium and 20 weight percent of molybdenum are introduced into molten nickel, whereupon its temperature is increased to 2000° C. Next 2 weight percent of rare-earth metals are introduced into the melt.

Following that 0.5 weight percent of carbon, 3.0 weight percent of titanium, 3.4 weight percent of zirconium and 0.8 weight percent of boron are introduced into the above melt in a stoichiometric ratio required for the formation of 2.62 volume percent of titanium carbide, 4.36 volume percent of titanium boride, 3.04 volume percent of zirconium carbide and 1.96 volume percent of zirconium boride.

Molten nickel with the aforesaid elements introduced therein is held at a temperature of 2000° C. for 2 minutes, whereupon it is cooled at a rate of $10^3$ degrees per second until 11.98 volume percent of dispersed high melting point titanium and zirconium carbides and titanium and zirconium borides are formed.

The dopant material thus obtained is introduced into a nickel-base alloy in amounts of 90 kg per each ton of metal at a temperature of 1650° C. In 4 minutes the alloy is poured at a temperature of 1570° C.

Characteristics of the nonmodified and modified alloy are given in Table 5 which shows that modification ensures a substantial enhancement of the plastic properties, impact toughness and stress-rupture strength.

Table 5

| | Mechanical properties | | | | | Stress-rupture strength |
|---|---|---|---|---|---|---|
| Kind of alloy | $\sigma_s$ kg/mm$^2$ | $\sigma_s$ % | $\delta$ % | $\alpha_k$ kgm/cm$^2$ | $\tau$ hr | Testing conditions |
| Nonmodified | 96.2 | 90 | 2.7 | 1.2 | 50 | $\sigma$ = 20 kg/mm$^2$ T = 975° C |
| Modified | 101.7 | 97.3 | 6.4 | 2.4 | 204 | " |

The introduction of the high melting point dispersed particles into the iron- and nickel-base alloys by making use of the invented dopant material does not necessitate a change in the technology of production of shaped castings and ingots.

What we claim is:

1. A method of producing a dopant material comprising the steps of melting a dopant base metal selected from the group consisting of iron and nickel; adding rare earth metals, manganese, silicon, molybdenum, and chromium to the molten metal; heating the molten metal to a temperature above that required for the dissolution and formation of high melting point compounds selected from the group consisting of carbides, nitrides, carbonitrides, borides, and oxides of a metal selected from the group consisting of titanium, zirconium, tantalum, hafnium, and thorium; adding non-metallic elements selected from the group consisting of carbon, nitrogen, oxygen, boron, and elements selected from the group consisting of titanium, zirconium, tantalum, hafnium, and thorium to the molten mixture in stoichiometric ratio and in weight amounts which provide for the formation of from 3 to 25 volume percent of said high melting point compounds in said dopant material; and cooling said molten mixture at a rate of from $10^2$ to $10^7$ degrees per second resulting in the formation of said endogenous high melting point compounds having a particle size of not more than 5 microns in said dopant material.

2. A method as claimed in claim 2, wherein the manganese, silicon and molybdenum are added to the molten base metal in an amount of not more than 50 weight percent.

3. A method as claimed in claim 2, wherein the rare-earth metals are added to the molten base metal in an amount of from 0.001 to 10 weight percent.

4. A method as claimed in claim 2, wherein the chromium is added to the molten base metal in an amount of not more than 50 weight percent.

* * * * *